US010383360B2

(12) United States Patent
Hufnagel et al.

(10) Patent No.: US 10,383,360 B2
(45) Date of Patent: Aug. 20, 2019

(54) WAX ENCAPSULATED FLAVOUR DELIVERY SYSTEM FOR TOBACCO

(71) Applicant: PHILIP MORRIS PRODUCTS, S.A., Neuchatel (CH)

(72) Inventors: Jan-Carlos Hufnagel, Singapore (SG); Monika Christlbauer, Gauting (DE); Irene Chetschik, Zurich (CH); Reiner Daiminger, Maribor (SI); Marcus Petermann, Witten (DE); Andreas Kilzer, Witten (DE); Zeljko Knez, Maribor (SI); Zoran Novak, Lovrenc na Pohorju (SI); Amra Perva Uzunalic, Maribor (SI); Neven Tutnjević, Bistrica ob Sotli (SI); Radoslav Jonak, Vojnik (SI); Andrej Nose, Šmarje Sap (SI); Urban Feguš, Celje (SI); Simon Henske, Bochum (DE)

(73) Assignee: PHILIP MORRIS PRODUCTS S.A., Neuchatel (CH)

( * ) Notice: Subject to any disclaimer, the term of this patent is extended or adjusted under 35 U.S.C. 154(b) by 254 days.

(21) Appl. No.: 15/104,107

(22) PCT Filed: Dec. 18, 2014

(86) PCT No.: PCT/IB2014/067097
§ 371 (c)(1),
(2) Date: Jun. 13, 2016

(87) PCT Pub. No.: WO2015/092748
PCT Pub. Date: Jun. 25, 2015

(65) Prior Publication Data

US 2016/0324209 A1 Nov. 10, 2016

Related U.S. Application Data

(60) Provisional application No. 61/919,047, filed on Dec. 20, 2013.

(30) Foreign Application Priority Data

Dec. 20, 2013 (EP) ..... 13198852

(51) Int. Cl.
*A24D 3/02* (2006.01)
*A24B 15/28* (2006.01)

(52) U.S. Cl.
CPC ..... *A24D 3/0216* (2013.01); *A24B 15/283* (2013.01); *A24B 15/285* (2013.01)

(58) Field of Classification Search
CPC ..... A24B 15/283; A24D 3/0216
See application file for complete search history.

(56) References Cited

U.S. PATENT DOCUMENTS 3,894,544 A 7/1975 Egri
4,597,970 A 7/1986 Sharma et al.
(Continued)

FOREIGN PATENT DOCUMENTS

CN 102349698 A 2/2012
EP 2415357 A1 * 2/2012 ..... A23P 20/11
(Continued)

OTHER PUBLICATIONS

Paraffin Wax, Encyclopedia Britannica, 2018.*
(Continued)

*Primary Examiner* — Anthony Calandra
(74) *Attorney, Agent, or Firm* — Mueting, Raasch & Gebhardt, P.A.

(57) ABSTRACT

A smoking composition includes tobacco material and a flavor delivery system. The flavor delivery system includes a flavor material and first wax material forming a core and a second wax material encapsulating the core. The second wax material being a different wax material than the first wax material.

20 Claims, 3 Drawing Sheets

(56) References Cited

U.S. PATENT DOCUMENTS

Figure 1:
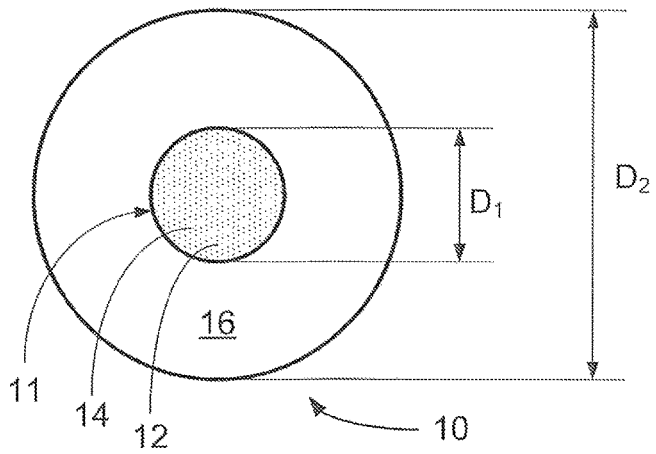

| | | | | |
|---|---|---|---|---|
| 5,724,998 | A | 3/1998 | Gellatly et al. | |
| 2005/0000531 | A1 | 1/2005 | Shi | |
| 2008/0163877 | A1 | 7/2008 | Zhuang et al. | |
| 2009/0269447 | A1 | 10/2009 | Brimmer et al. | |
| 2012/0325232 | A1 | 12/2012 | Yokogawa | |
| 2014/0366900 | A1* | 12/2014 | Plojoux | A24F 47/008 131/329 |
| 2015/0296874 | A1* | 10/2015 | Awty | B01J 13/04 131/337 |

FOREIGN PATENT DOCUMENTS

| | | | |
|---|---|---|---|
| GB | 983928 | A2 | 2/1965 |
| JP | 2007/259864 | | 10/2007 |
| RU | 123640 | U1 | 1/2013 |
| UA | 96976 | C2 | 12/2011 |
| WO | WO 91/17821 | A1 | 11/1991 |
| WO | WO 1995/021688 | A1 | 8/1995 |
| WO | WO 03/041521 | A2 | 5/2003 |
| WO | WO 2004/052128 | A2 | 6/2004 |
| WO | WO 2005/082180 | A2 | 9/2005 |

OTHER PUBLICATIONS

IRMWAX, Polyethylene waxes [downloaded online www.irmwax.com], downloaded on Oct. 19, 2018.*

International Preliminary Report on Patentability for PCT/IB2014/067097, issued by International Bureau of WIPO dated Jun. 30, 2016; 9 pgs.

International Search Report and Written Opinion for PCT/IB2014/067097, issued by the European Patent Office dated May 21, 2015; 12 pgs.

Office Action and Search Report issued by the Russian Patent Office for application No. 2016120716, dated Jul. 2, 2018; including English Translation: 13 pgs.

Office Action issued in corresponding Japanese Application No. 2016-534232, dated Oct. 18, 2018, including English Translation; 11 pgs.

* cited by examiner

WAX ENCAPSULATED FLAVOUR DELIVERY SYSTEM FOR TOBACCO

This application is the § 371 U.S. National Stage of International Application No. PCT/IB2014/067097, filed 18 Dec. 2014, which claims the benefit of U.S. Provisional Application No. 61/919,047, filed 20 Dec. 2013 and European Patent Application No. 13198852.9, filed 20 Dec. 2013, each of which are incorporated by reference herein.

This disclosure relates to flavour delivery systems for smoking articles, where the flavour material is encapsulated in wax and combined with tobacco for smoking articles.

Combustible smoking articles, such as cigarettes, typically have a tobacco substrate of shredded tobacco (usually in cut filler form) surrounded by a paper wrapper forming a tobacco rod. A cigarette is employed by a smoker by lighting one end of the cigarette and burning the tobacco rod. The smoker then receives mainstream smoke by drawing on the opposite end or mouth end of the cigarette, which typically contains a filter. Conventional cigarettes combust tobacco and generate temperatures that release volatile compounds into the mainstream smoke. To modify the flavour of the mainstream smoke, it is known to provide cigarettes with single and multi-segment mouthpiece filters that include flavourants, such as menthol.

A number of smoking articles in which an aerosol generating substrate, such as a tobacco substrate, is heated rather than combusted are known in the art. Such articles may be termed aerosol generating articles. Examples of systems using aerosol generating articles include systems that heat a tobacco containing substrate above 200 degrees centigrade to produce a nicotine containing aerosol. Typically in such heated aerosol-generating articles an inhalable aerosol is generated by the transfer of heat from a heat source to an aerosol-forming substrate or material, which may be located within, around or downstream of the heat source. During consumption of the aerosol-generating article, volatile compounds are released from the aerosol-forming substrate by heat transfer from the heat source and entrained in air drawn through the article. As the released compounds cool, they condense to form an aerosol that is inhaled by the consumer.

During the manufacture of these smoking articles the tobacco substrate is typically heated or dried to remove water, for example. During this heating or drying step volatile compounds, such as flavourants, are removed from the tobacco substrate, altering the taste of the smoking final article. Currently, flavouring agents are directly sprayed onto the dried tobacco substrate. This method is referred to as "top loading". This method is difficult as dosage and final concentration of the flavour on the tobacco substrate can depend on environmental conditions and the design of the spraying unit. In addition, flavour can migrate or evolve from the tobacco substrate during storage. All of these factors can lead to unwanted product taste variability It would be desirable to improve the smoking article taste uniformity and storage stability of flavourings added to the tobacco substrate (tobacco rod or aerosol generating substrate).

Smoking compositions having tobacco material with a flavour delivery system described herein can be utilized in conventional combustion smoking articles or in the aerosol generating substrate of aerosol generating smoking articles. The flavour delivery systems can provide a predictable and stable sustained release of flavour to smoking articles. This is especially useful when combined with aerosol generating substrates that are heated during production of the aerosol generating substrate.

As described herein, a smoking composition includes a flavour delivery system and tobacco material. The flavour delivery system includes a flavour material and first wax material forming a core and a second different wax material encapsulating the core. Preferably the first wax material has a melting point of about 100 degrees centigrade or greater. The flavour material can be a hydrophobic liquid. The tobacco material preferably is a homogenized tobacco or cast leaf tobacco that forms a aerosol generating substrate.

Various aspects of the smoking compositions having tobacco material with a flavour delivery system described herein may have one or more advantages relative to standard tobacco compositions. For example, the flavour delivery systems provide an enhanced flavour experience relative to tobacco compositions that do not include the flavour delivery system. The wax material does not contribute to or change the flavour notes of the tobacco composition. The wax materials encapsulate the flavour material to protect the flavour material during manufacture and storage of a smoking article that includes these tobacco compositions, while predictably releasing the flavour material during the consumption of the smoking article. Combining the flavour delivery system with tobacco material to form the smoking composition also provides a uniform distribution of flavour material throughout the smoking composition. The flavour delivery systems can replace or enhance the tobacco flavour notes that have been modified during the production of the aerosol generating substrate. In addition, the outer wax coating or shell surrounding or encapsulating the flavour and inner wax core can be a sacrificial layer that can operate as a thermal heat sink further protecting the core from releasing the flavour material during the manufacture or storage of the smoking composition. Additional advantages of one or more aspects flavour delivery system described herein will be evident to those of skill in the art upon reading and understanding the present disclosure.

The term "wax material" refers to natural or synthetic wax products that are hydrophobic and can convert to a melt-liquid state (dropping point) at temperatures below 200 degrees centigrade and are virtually free of ash forming compounds.

The term "flavourant" or "flavour" refers to organoleptic compounds, compositions, or materials that alter the taste or aroma characteristics of a tobacco substrate during consumption thereof.

The term "smoking article" includes cigarettes, cigars, cigarillos and other articles in which a smokable material, such as a tobacco, is lit and combusted to produce smoke. The term "smoking article" also includes those in which the smoking composition is not combusted such as, but not limited to, smoking articles that heat the smoking composition directly or indirectly, without burning or combusting the smoking composition, or smoking articles that neither combust nor heat the smoking composition, but rather use air flow or a chemical reaction to deliver nicotine, flavour compound or other materials from the tobacco substrate.

As used herein, the term "smoke" or "mainstream smoke" is used to describe an aerosol produced by heating or combusting a tobacco substrate of a smoking article. An aerosol produced by a smoking article may be, for example, smoke produced by combustible smoking articles, such as cigarettes, or aerosols produced by non-combustible smoking articles, such as heated smoking articles including aerosol generating articles or non-heated smoking articles.

As used herein, the term "atomizing" denotes a process whereby a liquid, which may contain molten material, a solution, an emulsion, or a combination of these, is caused to flow through one or more orifices in a sprayer, and broken into droplets or particles.

The present disclosure provides smoking compositions having tobacco material with a flavour delivery system for smoking articles. The flavour delivery system includes a flavour material and first wax material forming a core. The first wax material encapsulates the flavour material. A second wax material surrounds the core and forms an encapsulated core or a double encapsulated flavour material. The second wax material is a different wax material than the first wax material.

The flavour delivery system described herein provides an improved way in which to incorporate flavourants into a smoking article. The types of flavourants that are used in smoking articles are typically relatively volatile and it is difficult to retain acceptable levels of the flavourants within the smoking articles during manufacture and storage. The volatile flavourants may also migrate to other parts of the smoking articles and can adversely impact the performance of other components of the smoking article, such as any sorbents provided within the filter.

The flavour delivery system can controllably release a flavour or flavourant to its surrounding environment by increasing the temperature of the surrounding environment. The second wax material forms a shell around the core. In some embodiments the second wax material has a melting (dropping) point that is greater than the melting (dropping) point of the first wax material. In some embodiments the second wax material has a melting (dropping) point that is substantially equal to the melting (dropping) point of the first wax material. Preferably the second wax material has a melting (dropping) point that is less than the melting (dropping) point of the first wax material. The melting (dropping) point can be determined by using a standard test method for the dropping point of waxes known by ASTM D3954-94 (2010).

The flavour or flavourant can be dispersed or entrained in the first wax material or encased in the first wax material. If dispersed or entrained in the wax material, this is typically known as a matrix. In encased in the wax material, this is typically known as a core-shell arrangement. Thus, the core that comprises the first wax material and flavour may be a matrix or a core-shell arrangement. Preferably the flavour or flavourant is dispersed or entrained in the first wax material. In many embodiments the flavour or flavourant is dispersed in the first wax material when the first wax material is in the molten form. The core is a particle (referred to as a core particle) that can be formed by any useful method. Preferably the core particle is formed by atomization such as spray chilling. Spray chilling provides for a more homogeneous particle size than, for instance, conventional spray drying. In addition, spray chilling reduces the amount of heat applied to the flavour thus reducing losses by evaporation or undesirable changes in the flavour material. Preferably spray chilling is performed with an inert gas such as carbon dioxide or nitrogen to further reduce conversion or undesirable changes to the flavour material.

The core particle can then be encapsulated with the second wax material to form an encapsulated core. The core particle can be dispersed in the second wax material. Preferably the core particle is dispersed in the second wax material when the second wax material is in the molten form. The encapsulated core particle can be formed by any useful method. Preferably the encapsulated core particle is formed by atomization such as spray chilling, as described above.

Useful wax materials are chosen from among the group consisting of natural or synthetic waxes and mixtures thereof. Natural waxes are derived from animals, vegetables, minerals, and petroleum. Animal derived waxes include, for example, beeswax, Chinese wax, lanolin, shellac and spermaceti wax, and the like. Vegetable derived waxes include, for example, carnuba wax, candellila wax, bayberry wax, sugar cane wax, castor wax, esparto wax, Japan wax, jojoba wax, ouricury wax, rice bran wax, soy wax, and the like. Mineral derived waxes include, for example, ceresin wax, montan wax, ozocerite wax, peat wax, and the like. Petroleum derived waxes include, for example, paraffin wax, petroleum jelly, microcrystalline wax, and the like. Synthetic waxes include, for example, polyethylene waxes, Fischer-Tropsch waxes, chemically modified waxes, substituted amide waxes, polymerized alpha-olefins, and the like.

Particularly useful wax materials do not alter the flavour of the tobacco substrate, have an appropriate melting or dropping point, flash point, fire point, polarity and are safe for consumption. The flash and fire point of the wax materials is particularly relevant when the flavour delivery system described herein is combined with tobacco and heated during the manufacturing of the tobacco substrate. It is preferred to utilize wax materials have a flash point and fire point that is greater than the temperatures applied to the wax materials during the manufacturing process. The flash point is the lowest temperature at which a flame will ignite the vapors of the heated excipient, while the fire point is the lowest temperature when the vapors ignite and burn for at least 2 seconds.

Exemplary useful waxes include polyethylene waxes, polyethylene glycol waxes, or vegetable waxes.

Illustrative polyethylene waxes are available under the trade designation CERIDUST from Clariant International Ltd., Switzerland. Illustrative polyethylene glycol waxes are available under the trade designation CARBOWAX from Dow Chemical Co., USA. Illustrative vegetable waxes are available under the trade designation REVEL from Loders Croklaan, Netherlands.

Flavourants or flavours can be liquid or solid flavours (at room temperature of about 22 degrees centigrade and one atmosphere pressure) and can include flavour formulations, flavour-containing materials and flavour precursors. The flavourant may include one or more natural flavourants, one or more synthetic flavourants, or a combination of natural and synthetic flavourants. Preferably the flavour is a liquid. Preferably the flavour is a hydrophobic liquid.

The hydrophobic liquid flavour is generally soluble in organic solvents but only weakly soluble in water. Preferably, this hydrophobic liquid flavour is characterized by a Hildebrand solubility parameter smaller than 30 $MPa^{1/2}$. The aqueous incompatibility of most oily liquids can be in fact expressed by means of Hildebrand's solubility parameter $\delta$ which is generally below 25 $MPa^{1/2}$, while for water the same parameter is of 48 $MPa^{1/2}$, and 15-16 $mPa^{1/2}$ for alkanes. This parameter provides a useful polarity scale correlated to the cohesive energy density of molecules. For spontaneous mixing to occur, the difference in $\delta$ of the molecules to be mixed must be kept to a minimum. The Handbook of Solubility Parameters (ed. A. F. M. Barton, CRC Press, Bocca Raton, 1991) gives a list of $\delta$ values for many chemicals as well as recommended group contribution methods allowing $\delta$ values to be calculated for complex chemical structures.

Flavourants or flavours refer to a variety of flavour materials of natural or synthetic origin. They include single compounds and mixtures. Preferably the flavour or flavourant has flavour properties that enhance the experience of a non-combustible smoking article to, for example, provide an experience similar to that resulting from smoking a combustible smoking article. For example, the flavour or flavourant can enhance flavour properties such as mouth fullness and complexity. Complexity is generally known as the overall balance of the flavour being richer without dominating single sensory attributes. Mouth fullness is described as perception of richness and volume in the mouth and throat of the consumer.

Suitable flavours and aromas include, but are not limited to, any natural or synthetic flavour or aroma, such as tobacco, smoke, menthol, mint (such as peppermint and spearmint), chocolate, licorice, citrus and other fruit flavours, gamma octalactone, vanillin, ethyl vanillin, breath freshener flavours, spice flavours such as cinnamon, methyl salicylate, linalool, bergamot oil, geranium oil, lemon oil, and ginger oil, and the like.

Other suitable flavours and aromas may include flavour compounds selected from the group consisting of an acid, an alcohol, an ester, an aldehyde, a ketone, a pyrazine, combinations or blends thereof and the like. Suitable flavour compounds may be selected, for example, from the group consisting of phenylacetic acid, solanone, megastigmatrienone, 2-heptanone, benzylalcohol, cis-3-hexenyl acetate, valeric acid, valeric aldehyde, ester, terpene, sesquiterpene, nootkatone, maltol, damascenone, pyrazine, lactone, anethole, iso-s valeric acid, combinations thereof, and the like.

Further specific examples of flavours may be found in the current literature, for example, in Perfume and Flavour Chemicals, 1969, by S. Arctander, Montclair N.J. (USA); Fenaroli's Handbook of Flavour Ingredients, CRC Press or Synthetic Food Adjuncts by M. B. Jacobs, van Nostrand Co., Inc. They are well-known to the person skilled in the art of flavouring, i.e. of imparting an odor or taste to a product.

In some embodiments, the flavourant is a high potency flavourant, and is typically used at levels that would result in less than 200 parts per million in the aerosol or mainstream smoke. Examples of such flavourants are key tobacco aroma compounds such as beta-damascenone, 2-ethyl-3,5-dimethylpyrazine, phenylacetaldehyde, guaiacol, and furaneol. Other flavourants can only be sensed by humans at higher concentration levels. These flavourants, which are referred to herein as the low potency flavourants, are typically used at levels that results in orders of magnitude higher amounts of flavourant released into the aerosol or mainstream smoke. Suitable low potency flavourants include, but are not limited to, natural or synthetic menthol, peppermint, spearmint, coffee, tea, spices (such as cinnamon, clove and ginger), cocoa, vanilla, fruit flavours, chocolate, eucalyptus, geranium, eugenol and linalool.

In preferred embodiments the flavour delivery system first wax material has a melting point of about 100 degrees centigrade or greater, or about 120 degrees centigrade or greater, or about 140 degrees centigrade or greater, or about 150 degrees centigrade or greater. In many embodiments the first wax material has a melting point in a range from about 100 degrees centigrade to 150 degrees centigrade or from about 110 degrees centigrade to about 140 degrees centigrade. In many embodiments the first wax material has a melting point up to or less than about 200 degrees centigrade.

In preferred embodiments the flavour delivery system second wax material has a melting point of about 100 degrees centigrade or less, or about 90 degrees centigrade or less, or about 80 degrees centigrade or less, or about 70 degrees centigrade or less. In many embodiments the second wax material has a melting point in a range from about 50 degrees centigrade to 100 degrees centigrade, or from about 50 degrees centigrade to about 80 degrees centigrade. In many embodiments the second wax material has a melting point down to about 40 degrees centigrade.

In preferred embodiments the first wax material has a higher melting point than the second wax material. In some embodiments the first wax material has a higher melting point that is about 30 degrees, or at least 40 degrees or at least 50 degrees higher than the second wax material. Flavour is released from the flavour delivery system as the first wax material is heated above its melting point. Preferably the first and second wax materials are chosen having a difference in melting point such that on application of the second wax material, there is little or substantially no melting of the first wax material of the core.

The flavour material in the core can be any useful amount. In many embodiments the flavour is present in the core in at least about 5 wt %. In many embodiments the flavour is present in the core in at less than about 50 wt %. In many embodiments the flavour is present in the core in a range from about 5 to about 50 wt %, or from about 5 to about 35 wt %, or from about 10 to about 30 wt %.

The use of the flavour delivery system described herein to provide a flavourant within a smoking article advantageously reduces the loss of the flavourant during storage so that a larger proportion of the flavourant is retained within the smoking article. The flavour delivery system can therefore provide a more intense flavour to the mainstream smoke. Since the loss of the flavourant is reduced, it is possible to incorporate a smaller amount of the flavourant into each smoking article whilst providing the same effect on the flavour as provided in current smoking articles.

The core can have any useful particle size or largest lateral dimension. In many embodiments the core has a particle size of less than about 30 micrometers or less than about 20 micrometers. In many embodiments the core has a particle size greater than about 1 micrometer or greater than about 5 micrometers. In many embodiments the core has a particle size in a range from about 1 to about 30 micrometers, or from about 5 to about 25 micrometers, or from about 5 to about 20 micrometers.

The encapsulated core can have any useful particle size or largest lateral dimension. In many embodiments the encapsulated core has a particle size of less than about 250 micrometers or less than about 200 micrometers. In many embodiments the encapsulated core has a particle size greater than about 25 micrometers or greater than about 50 micrometers. In many embodiments the encapsulated core has a particle size in a range from about 25 to about 300 micrometers, or from about 25 to about 250 micrometers, or from about 50 to about 200 micrometers.

The core can be combined with the first wax material in any useful amount to from the encapsulated core or flavour delivery system. In many embodiments the core represents at least about 1 wt % of the encapsulated core particle total weight. In many embodiments the core represents at least about 5 wt % of the encapsulated core particle total weight. In many embodiments the core represents less than about 50 wt % of the encapsulated core particle total weight. In many embodiments the core is represents a range from about 1 to about 50 wt % of the encapsulated core particle total weight, or from about 5 to about 50 wt % of the encapsulated core particle total weight, or from about 10 to about 35 wt % of the encapsulated core particle total weight.

The flavour delivery system is combined with tobacco material to form a tobacco composition or smoking composition that provides a stable and predictable flavour release as the tobacco composition or smoking composition is heated to temperature to melt the wax material and release the flavour into the mainstream smoke or aerosol for consumption. The flavour delivery system can be combined with cut tobacco to form a tobacco composition or smoking composition for use with conventional combustion smoking articles. Preferably the flavour delivery system can be combined with reconstituted or homogenized tobacco to form a tobacco composition or smoking composition for use with aerosol generating articles. Preferably the homogenized tobacco is a cast leaf tobacco.

Smoking articles can include an aerosol generating substrate that is assembled, often with other components, in the form of a rod. Typically, such a rod is configured in shape and size to be inserted into an aerosol generating device that comprises a heating element for heating the aerosol generating substrate.

"Aerosol forming substrate" or "aerosol generating substrate" as used herein is a type of smoking composition that can be used in an aerosol generating device to produce an aerosol. The aerosol generating substrate can release a flavour compound upon heating. The aerosol generating substrate can comprise both liquid and solid components. The aerosol generating substrate may comprise tobacco material and the described flavour delivery system wherein the flavour is released from the substrate upon heating. Preferably the aerosol generating substrate is not combusted. The aerosol generating substrate may further comprise an aerosol former. Examples of suitable aerosol formers are glycerine and propylene glycol. Optionally, the aerosol generating substrate may be provided on or embedded in a carrier which may take the form of powder, granules, pellets, shreds, spaghetti strands, strips or sheets. The aerosol generating substrate may be deposited on the surface of the carrier in the form of, for example, a sheet, foam, gel or slurry. The aerosol generating substrate may be deposited on the entire surface of the carrier, or alternatively, may be deposited in a pattern in order to provide a non-uniform flavour delivery during use.

Homogenized tobacco can be used to make an aerosol generating substrate for use in smoking articles that are being heated in an aerosol generating device. As used herein, the term "homogenized tobacco" denotes a material formed by agglomerating particulate tobacco. Tobacco dust created by tobacco breakage during shipping and manufacturing, leaf lamina, stems and other tobacco by-products that are finely ground may be mixed with a binder to agglomerate the particulate tobacco. Homogenized tobacco may comprise other additives in addition to a flavour composition or a flavour delivery composition, including but not limited to, aerosol-formers, plasticizers, humectants, and non-tobacco fibers, fillers, aqueous and non-aqueous solvents and combinations thereof. Homogenized tobacco can be cast, extruded, or rolled. A number of reconstitution processes for producing homogenized tobacco materials are known in the art. These include, but are not limited to: paper-making processes of the type described in, for example, U.S. Pat. No. 5,724,998; casting (cast leaf) processes of the type described in, for example, U.S. Pat. No. 5,724,998; dough reconstitution processes of the type described in, for example, U.S. Pat. No. 3,894,544; and extrusion processes of the type described in, for example, in GB983,928.

The flavour delivery system can be incorporated into tobacco material such as, cast leaf tobacco substrate formed by a cast leaf process, for example. This type of process is known as cast leaf process and is used by the tobacco industry for the manufacturing of reconstituted or homogenized tobacco for use in conventional cigarette. Cast leaf tobacco substrates can be formed by combining homogenized tobacco powder with water, glycerine, and other optional additives to form a slurry and combining the described flavour delivery system in the slurry. The slurry is then cast into a form and dried (heated) to remove water and form the cast leaf tobacco substrate.

A cast leaf process may involve applying temperatures of up to about 140° C., such as between about 90° C. and 140° C. Accordingly, the one or both of the wax materials of the flavour delivery system is preferably stable at such temperatures. Preferably the first wax material of the core is stable at these temperatures so that the flavour is not released during the drying step of the cast leaf process. In many embodiments the second wax material has a melting point that is substantially the same as the drying temperature of the drying step of the cast leaf process. In some embodiments the second wax material has a melting point that is less than the drying temperature of the drying step of the cast leaf process. In these embodiments at least a portion of the shell or second wax material melts away from of melts off the core and is dispersed within the homogenized tobacco material. Preferably the first wax material forming the flavour core has a melting point that is greater than the temperature used to form the cast leaf tobacco substrate.

All scientific and technical terms used herein have meanings commonly used in the art unless otherwise specified. The definitions provided herein are to facilitate understanding of certain terms used frequently herein.

As used herein, the singular forms "a", "an", and "the" encompass embodiments having plural referents, unless the content clearly dictates otherwise.

As used herein, "or" is generally employed in its sense including "and/or" unless the content clearly dictates otherwise. The term "and/or" means one or all of the listed elements or a combination of any two or more of the listed elements.

As used herein, "have", "having", "include", "including", "comprise", "comprising" or the like are used in their open ended sense, and generally mean "including, but not limited to". It will be understood that "consisting essentially of", "consisting of", and the like are subsumed in "comprising," and the like.

The words "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the disclosure, including the claims.

FIG. 1 is a schematic diagram of an illustrative flavour delivery system 10 or encapsulated flavour core. The schematic drawing is not necessarily to scale and is presented for purposes of illustration and not limitation. The drawing depicts one or more aspects described in this disclosure. However, it will be understood that other aspects not depicted in the drawing fall within the scope and spirit of this disclosure.

Referring now to FIG. 1, the flavour delivery system 10 includes a flavour material 12 and first wax material 14 forming a core 11 and a second wax material 16 encapsulating the core 11. The second wax material 16 is a different wax material than the first wax material 14.

The core 11 has a particle size or largest lateral dimension $D_1$. The flavour delivery system 10 has a particle size or largest lateral dimension $D_2$.

Non-limiting examples illustrating flavour delivery system as described above and tobacco substrates and smoking articles having such flavour delivery systems are described below.

EXAMPLES

A variety of wax materials were evaluated as described below for suitability in the flavour delivery system as described above.

Flash and fire points for selected wax excipients were determined according ISO 2592 (Cleveland open cup method). The flash point is the lowest temperature at which a flame will ignite the vapors of the heated excipient, while the fire point is the lowest temperature when the vapors ignite and burn for at least 2 seconds. It will be appreciated that the melting point in practice for the wax material will depend on for example any impurities or other components in the wax, as well as the pressure. Results of this testing is reported in Table 1 under ambient pressure.

TABLE 1

| Wax | Type | Fire point (° C.) | Flash point (° C.) | Supplier | Melting point (° C.) |
|---|---|---|---|---|---|
| Rice bran (Kahlwax 2811) | Natural wax | 299 | 333 | Kahlwax/ Kahlwax | 79-85 |
| Sunflower wax (Kahlwax 6607) | Natural wax | 305 | 335 | Kahlwax/ Kahlwax | 74-80 |
| Carnauba wax (Kahlwax 2442L) | Natural wax | 315 | 345 | Kahlwax/ Kahlwax | 82-86 |
| Candelilla wax (Kahlwax 2039) | Natural wax | 269 | 299 | Kahlwax/ Kahlwax | 68-73 |
| Cutina wax | Hard Fat | 325 | 341 | CareChemicals | 83-88 |
| Licowax 521 PED | Polyethylene wax | 249 | >309 | Clariant/Parka d.o.o. | 101-106 |
| Ceridust 2051 | Polyolefin wax | 297 | 329 | Clariant/Parka d.o.o. | 108-116 |
| Ceridust 3610 | Polyethylene wax | 263 | >303 | Clariant/Parka d.o.o. | 125-130 |
| Deurex MX 9820 | Polypropylene wax | 277 | 329 | Deurex/Deurex | 110-118 |
| Deurex ME 1620 | Polyethylene wax | 261 | >321 | Deurex/Deurex | 122-130 |
| Deurex MT 9120 | Fischer-Tropsch wax | 295 | 339 | Deurex/Deurex | 112-120 |
| Sasolwax H1 | Fischer-Tropsch wax | 287 | 327 | Sasolwax/HDS Chemie | 112 |
| Sasolwax H105 | Fischer-Tropsch wax | na | Na | Sasolwax/HDS Chemie | 117 |
| Vestowax EH100 | Fischer-Tropsch wax | 267 | 295 | Evonik/Evonik | 102-110 |
| Vestowax SH105 | Fischer-Tropsch wax | 310 | 333 | Evonik/Evonik | 108-114 |
| PEG 6000 | Polymer | 233 | >259 | Merck | 55-60 |
| PEG 35000 | Polymer | 259 | >319 | Merck | 60-65 |
| Ceridust 6050M | Polypropylene wax | 271 | 319 | Clariant/Parka d.o.o. | 142-148 |

TABLE 1-continued

| Wax | Type | Fire point (° C.) | Flash point (° C.) | Supplier | Melting point (° C.) |
|---|---|---|---|---|---|
| Revel A | Hard fat | 319 | 347 | Loders Croklaan | — |

A sensory analysis of wax materials is determined using the descriptive criterion "overall sensory neutrality" to indicate intensity differences. As sensory and psychological fatigue sets in after 7-8 samples, a balanced incomplete block design (BiB) (ISO 29842) is selected for the ranking test (ISO 8587). Assessors receive per session five samples in random order and are asked to rank the samples according to the criterion. Four sessions are performed in order to achieve an adequate level of precision. Results of this BiB ranking are reported in Table 2.

TABLE 2

| | | BiB Ranking | | | | | | |
|---|---|---|---|---|---|---|---|---|
| | | rank sum | LSD = 13 | | | | | |
| 0 | Tixosil | 45 | A | | | | | |
| I | Deurex ME 9120 | 37 | A | B | | | | |
| | Sasolwax H1 | 35 | A | B | C | | | |
| | Ceridust 3610 | 33 | A | B | C | | | |
| | Ceridust 2051 | 33 | A | B | C | | | |
| | Cutina HR | 33 | | B | C | | | |
| | Vestowax EH 100 | 32 | | B | C | | | |
| II | Vestowax SH 105 | 28 | | B | C | D | | |
| | Sasolwax H105 | 27 | | B | C | D | E | |
| | Kahlwax 2811 (Rice Bran) | 27 | | B | C | D | E | |
| III | Kahlwax 2442L (Carnauba) | 25 | | B | C | D | E | F |
| | Kahlwax 2039 (Candelilla) | 23 | | | C | D | E | F |
| IV | Deurex ME 1620 | 18 | | | | D | E | F |
| | Deurex ME 9820 | 17 | | | | D | E | F |
| | Licowax PED 521 GR | 15 | | | | | E | F |
| | Kahlwax 6607 (Sunflower) | 14 | | | | | | F |

A number of flavour delivery system are formed by first spray chilling a flavour with a first wax material to form a core and then spray chilling the core with a second wax material to form the encapsulated core or flavour delivery system. Table 3 reports the results of the materials screened.

TABLE 3

| Example no. | Core | shell | flavour load | sieve fraction |
|---|---|---|---|---|
| 1 | ceridust 3610 (polyethylene wax) | Revel A | 25% | 63-125 μm |
| 2 | ceridust 3610 (polyethylene wax) | Revel A | 25% | 125-250 μm |
| 3 | ceridust 3610 (polyethylene wax) | Revel A | 35% | 63-125 μm |
| 4 | ceridust 3610 (polyethylene wax) | Revel A | 35% | 125-250 μm |
| 5 | ceridust 3610 (polyethylene wax) | Sunflower wax | 25% | 63-125 μm |
| 6 | ceridust 3610 (polyethylene wax) | Sunflower wax | 25% | 125-250 μm |

These samples are then analyzed for particle size distribution, bulk density and morphology.

The particle size distribution is measured by laser diffraction method with the Malvern Mastersizer 2000. The liquid dispersion unit "Hydro MU" is used to measure the particles dispersed in ethanol. After the samples are dispersed in ethanol the ultrasonic bath is turned on for a period of 3 minutes to break the agglomerates. After 1 minute the measurement is initiated. All samples are measured twice and the average values are reported. The interpretation of the data is done according to the theory of Fraunhofer.

The Mastersizer breaks the agglomerates by using an ultrasonic batch prior to the particle size measurement; the particle size measured by laser diffraction method differs from the expected particle size of the sieved fractions. By sieving the samples, the agglomerates are not destroyed and the sieved fractions in fact consist of agglomerates rather than fractions of single particles.

Figure 2:
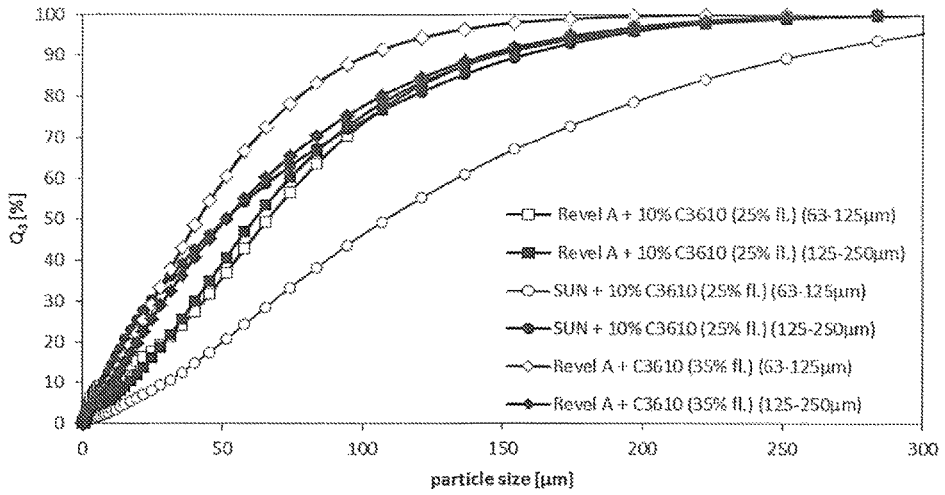

FIG. 2 reports the particle size distributions of the core-shell samples of Examples 1-6 produced by the double spray chilling process described above.

Figure 3:
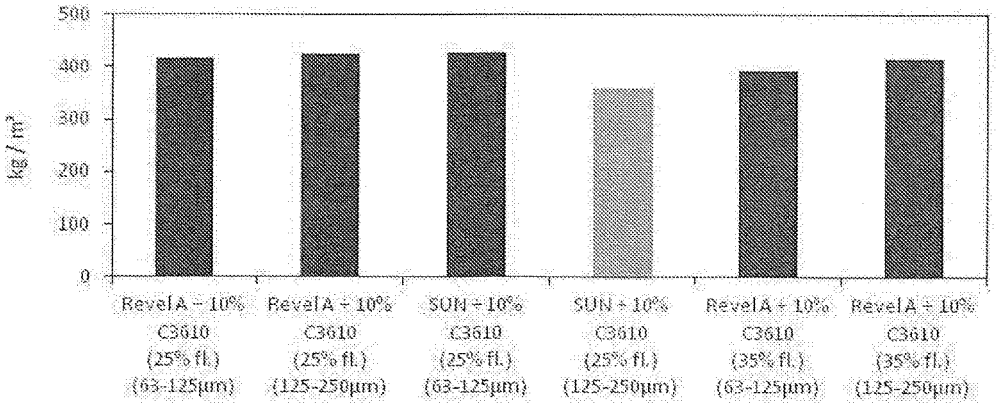
Figure 4:
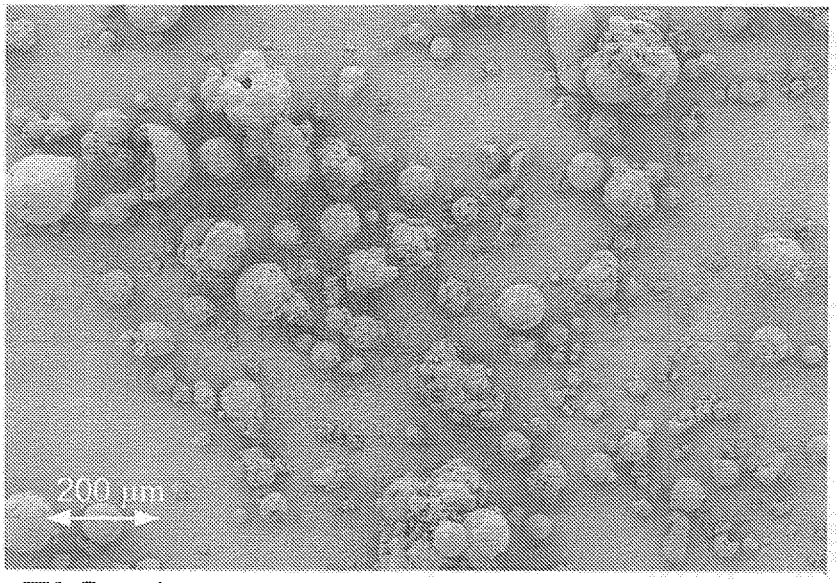
Figure 5:
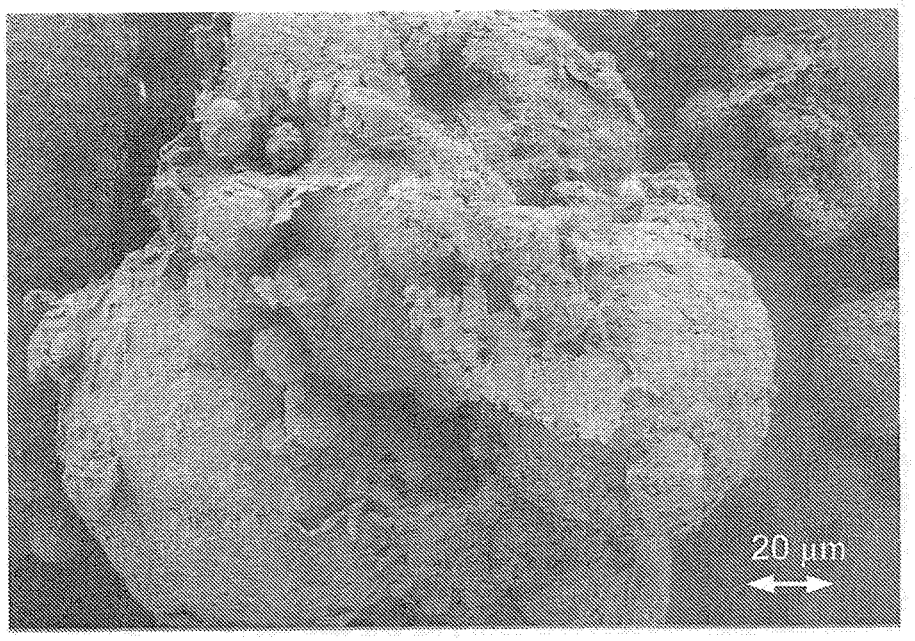
Figure 6:
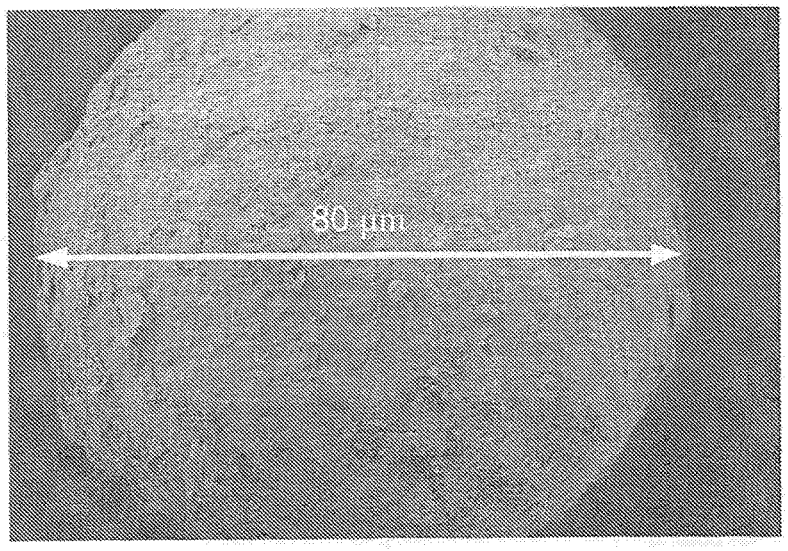

The bulk density of the core-shell samples of Examples 1-6 is measured in accordance to DIN ISO 697. In FIG. 3 the bulk densities is reported. FIGS. 4-6 show scanning electron microscope (SEM) pictures of Example 1 (Revel A+10% C3610 −25% fl.−63-125 μm). FIG. 4 gives an overview picture of the particles in Example 1. Nearly all particles are spherical. In FIG. 5 a close up of an agglomerate is shown. The big particles indicate double encapsulated particles and the small particles indicate a single layer of encapsulate. FIG. 6 shows a close up of a single particle with a particle size of about 80 μm. The surface is very smooth and without any capillaries or holes.

The flavour release of the flavour delivery system described herein was then evaluated. A flavour delivery system described herein that was formed by a two stage spray chilling was added to a cast leaf slurry prior to cast leaf tobacco substrate generation at a level of 3% (w/w). The cast leaf was generated according to a standard cast-leaf procedure involving a drying step at approximately 100° C. No special observations were made during cast leaf manufacturing, indicating no to low flavour losses. Using the generated cast leaf, consumables (tobacco sticks) were manufactured to be used in the aerosol generating substrate.

Flavour release analyses were performed by the Health Canada Intense Smoking Regime. The following two examples illustrate the successful release of flavouring ingredients by the described flavour delivery system. For both examples the quantified flavouring ingredients are not detectable in the aerosol of the consumable without addition of the flavour delivery system described herein.

The release quantification of the flavouring agent 3-ethylphenol using a combination of Revel A/ceridust (35%) with a particle size of 63-125 μm (see Example 3) in the cast leaf of the consumable was about 14 ng per 12 puffs Health Canada intense regime.

The release quantification of the flavouring agent pyrazine using a combination of sunflower/ceridust (25%) at a particle size of 63-125 μm (see Example 5) in the cast leaf of the consumable was about 18 ng per 12 puffs Health Canada intense regime.

The invention claimed is:

1. A smoking composition comprising tobacco material and a flavour delivery system, the flavour delivery system comprising:

a flavour material and a first wax material forming a core; and a second wax material surrounding and disposed directly on the core and forming an encapsulated flavour particle, the second wax material being a different wax material than the first wax material, wherein the core makes up from 1% to 50% of a total weight of the encapsulated flavour particle.

2. The smoking composition according to claim 1, wherein the first wax material has a melting point of about 100 degrees centigrade or greater.

3. The smoking composition according to claim 1, wherein second wax material has a melting point that is less than the melting point of the first wax material.

4. The smoking composition according to claim 1, wherein the flavour material is a hydrophobic liquid.

5. The smoking composition according to claim 1, wherein the flavour material is entrained or dispersed in a matrix of the first wax material.

6. The smoking composition according to claim 1, wherein the encapsulated flavour particle has a particle size in a range from about 25 micrometers to about 250 micrometers.

7. The smoking composition according to claim 1, wherein the tobacco material comprises homogenized tobacco.

8. The smoking composition according to claim 1, wherein the tobacco material comprises cast leaf tobacco.

9. The smoking composition according to claim 1, wherein at least a portion of the second wax material is melted off the core and is dispersed within the tobacco material.

10. The smoking composition according to claim 2, wherein second wax material has a melting point that is less than the melting point of the first wax material.

11. The smoking composition according to claim 4, wherein the flavour material is entrained or dispersed in a matrix of the first wax material.

12. The smoking composition according to claim 7, wherein at least a portion of the second wax material is melted off the core and is dispersed within the tobacco material.

13. The smoking composition according to claim 8, wherein at least a portion of the second wax material is melted off the core and is dispersed within the tobacco material.

14. A smoking article comprising an aerosol generating substrate comprising the smoking composition of claim 1.

15. A method of forming the smoking composition according to claim 1 comprising the steps:

combining the tobacco material with the flavour delivery system to form a tobacco mixture; and heating the tobacco mixture to form the smoking composition.

16. The method according to claim 15, wherein the tobacco material comprises homogenized tobacco and water and the heating step removes at least a portion of the water from the tobacco mixture to form the smoking composition.

17. The method according to claim 15, wherein the heating step melts at least a portion of the second wax material.

18. The method according to claim 17, wherein the heating step does not melt the first wax material.

19. The method according to claim 16, wherein the heating step melts at least a portion of the second wax material.

20. The method according to claim 19, wherein the heating step does not melt the first wax material.

* * * * *